US007304228B2

(12) United States Patent
Bryden et al.

(10) Patent No.: US 7,304,228 B2
(45) Date of Patent: Dec. 4, 2007

(54) CREATING REALTIME DATA-DRIVEN MUSIC USING CONTEXT SENSITIVE GRAMMARS AND FRACTAL ALGORITHMS

(75) Inventors: Kenneth M. Bryden, Ames, IA (US); Kristy Ann Bryden, Ames, IA (US); Daniel Abram Ashlock, Guelph (CA)

(73) Assignee: Iowa State University Research Foundation, Inc., Ames, IA (US)

( * ) Notice: Subject to any disclaimer, the term of this patent is extended or adjusted under 35 U.S.C. 154(b) by 0 days.

(21) Appl. No.: 10/985,301

(22) Filed: Nov. 10, 2004

(65) Prior Publication Data

US 2005/0115381 A1 Jun. 2, 2005

Related U.S. Application Data

(60) Provisional application No. 60/518,848, filed on Nov. 10, 2003.

(51) Int. Cl.
*G10H 1/00* (2006.01)

(52) U.S. Cl. ..... 84/600; 84/609; 84/615

(58) Field of Classification Search ..... 84/600, 84/609, 649, 615

See application file for complete search history.

(56) References Cited

U.S. PATENT DOCUMENTS 3,752,031 A * 8/1973 Mohos ..... 84/471 R
5,371,854 A * 12/1994 Kramer ..... 704/270
5,831,633 A * 11/1998 Van Roy ..... 345/441
7,138,575 B2 * 11/2006 Childs et al. ..... 84/615
2004/0055447 A1 * 3/2004 Childs et al. ..... 84/615

OTHER PUBLICATIONS http://www.fractal-vibes.com/fvc/music/Angels.ram Accessed Jan. 11, 2006. This illustrates an example of fractal music which would not be considered atonal. This is in an audio file and therefore not supplied with this Office Action.* http://www.fractal-vibes.com/fvc/music/guests2.htm Accessed Jan. 11, 2006. Describes "atonal" composition, i.e., fractal compostion techniques.*

"Six Techniques for Algorithmic Music Composition." Peter S. Langston. International Computer Music Conference (ICMC) in Columbus, Ohio, Nov. 2-5, 1989.*

"Score Generation with L-Systems." Prusinkiewicz, P., International Computer Music Conference 86 Proceedings, 1986, pp. 455-457.*

"Six Techniques for Algorithmic Music Composition" Langston, Peter S., 1988 International Computer Music Conference. Viewed online at http://www.langston.com/Papers/amc.pdf on Nov. 22, 2006.*

(Continued)

*Primary Examiner*—Lincoln Donovan
*Assistant Examiner*—David S. Warren
(74) *Attorney, Agent, or Firm*—McKee, Voorhees & Sease, P.L.C.

(57) ABSTRACT

Musical approaches are applied to the sonification of data. The musical approaches do not require directly mapping data to sound. Data is interpreted and transformed into sound through Lindemayer-systems or other methods. Where fractals are used in the interpretation and transformation of data to sounds the use of fractals provided needed phrasing to create a sense of forward motion in the music and to reveal a rich complexity in the details of the data.

13 Claims, 4 Drawing Sheets

| Iterations | L-string for each iteration |
|---|---|
| 0 | 0 |
| 1 | 0-1 |
| 2 | [0*1]-2 |
| 3 | [[0/1]*2]-1 |
| 4 | [[0-1/2](3]-2 |
| 5 | [[[0*1]-2/3]*2]-1 |

OTHER PUBLICATIONS

VanScoy, Frances L., et al. "Sonification: Hearing with Your Ears"; West Virginia University, no date.
Bargar, Robin, et al. "Sonification Report: Status of the Field and Research Agenda" National Science Foundation pp. 1-26;http://www.icad.org/website V2.0/Refernces/nsl.html; Nov. 9, 2004.
VanScoy, Frances L., et al. "Sonification of Complex Data Sets: An Example from Basketball" West Virginia University; http://www.csee.wvu.edu/~vanscoy/vsmm99/webmany/FLVS00.html ; Nov. 9, 2004.
VanScoy, Frances "Sonification of Basketball Data" Computer Science and Electrical Engineering, West Virginia University: https://etd.wvu.edu/etd/etdDocumentData.jsp?jsp_etdId=2227; Nov. 9, 2004.
VanScoy, Frances L., et al. "Haptic Display of Mathematical Functions for Teaching Mathematics to Students with Vision Disaibolities: Design andProof of Concept" May 2003 http://springerlink.metapress.com/app/home/contribution.asp?wasp=46ghqhmrqp5aacj2c . . . May 2003.
VanScoy, Frances L., et al. The Sound and Touch of Mathematics: a Prototype System: West Virginia University; fvanscoy@wvu.edu, no date.
VanScoy, Frances L., et al. "Sonification of Remote Sensing Data: Initial Experiment" fvanscoy@wvu.edu, no date.
IPT Symposium Program, Mar. 2002, Proceedings Seventh Annual Immersive Projection Technology Symposium; http://www.view.iao/fraunhofer.de/IPT2002/program.html, Mar. 2002.

* cited by examiner

| Data | Rounded Values | Pitches |
|---|---|---|
| 1.2 | 1 | C4 |
| 4.3 | 4 | F4 |
| 5.3 | 5 | G4 |

*FIG. 1*

AGTGCTGTGCCAGHCTGCTAG

*FIG. 2*

| base C | base G | base A | base T |
|---|---|---|---|
| 0->[0/1] | 0->[0*1] | 0->0-1 | 0->[0 1] |
| n->(n+1) if n<>0 | n->(n+1) if n<>0 | n->(n+1) if n<>0 | n->(n+1) if n<>0 |

*FIG. 3*

| Iterations | L-string for each iteration |
|---|---|
| 0 | 0 |
| 1 | 0-1 |
| 2 | [0*1]-2 |
| 3 | [[0/1]*2]-1 |
| 4 | [[0-1/2](3]-2 |
| 5 | [[[0*1]-2/3]*2]-1 |

*FIG. 4*

CREATING REALTIME DATA-DRIVEN MUSIC USING CONTEXT SENSITIVE GRAMMARS AND FRACTAL ALGORITHMS

CROSS-REFERENCE TO RELATED APPLICATIONS

This application is a conversion of U.S. Provisional Application No. 60/518,848, filed Nov. 10, 2003, which is herein incorporated by reference in its entirety.

BACKGROUND OF THE INVENTION

The present invention relates to the use of musical principles in the sonification of data. More particularly, but not exclusively, the invention relates to a method and system to represent data with music utilizing generic fractal algorithm techniques. Currently, most data is represented visually in various two-dimensional and three-dimensional platforms. However, we live in a world filled with sound and receive a wide range of information aurally. As we drive our car we hear the tires on the road, the engine, the wind on the car, and other cars. By adding this information to our visual cueing, we more fully understand our environment. Sound directs our viewing and adds essential contextual information.

Numerous efforts have been made to sonify data; that is, represent data with sounds. However, rather than employing a musical approach, these efforts map data directly to various aspects of sound, resulting in a medium that is difficult to understand or irritating to listen to. The approach presented here is unique in that it uses musical principles to overcome these drawbacks. Moreover, unlike direct mapping from data to sound, which can only bring out the micro-scale aspects of the data, music can highlight the connection between the micro and macro scale. Additionally, because music can convey a large amount of information, it can enable users to perceive more facets of the data.

Currently, there are two main approaches to sonification of data. The primary difference between them is the means by which the sound is produced. One approach is directly mapping data parameters to various sound parameters (e.g., frequency, vibrato, reverberation) via synthesis algorithms. One of the largest efforts using this approach is the Scientific Sonification Project at the University of Illinois-Urbana/Champaign (Kaper and Tipei, 1998). A second approach utilizes MIDI parameters to represent data as pitch, volume, pre-made instrumental and vocal sounds, and rhythmic durations. This approach opens a broader range of sonification options but complicates the mapping of the data parameters to the sound parameters. Two sonification toolkits—Listen and MUSE (Musical Sonification Environment)—are the primary vehicles for this approach (Wilson and Lodha, 1996 and Lodha et al., 1997). In both approaches, the data is directly mapped with little effort to understand the underlying micro- and macro-scale patterns within the data and the relationship between them.

One way direct mapping of data to sound is accomplished is by assigning variable data to specific pitches or note values. FIG. 1 provides an example of direct mapping of data to specific pitches. The equivalent of direct mapping in the visual world would be assigning color to specific values and regions of three-dimensional space without further data transformation. This results in an incomprehensible conglomeration of color. However, if transformation of the data recognizes the underlying physics of the data, the data is instead comprehensible, and patterns and nuances in the data can be identified.

Therefore, despite advancements in the art, problems remain. Therefore, it is a primary object, feature, or advantage of the present invention to improve upon the state of the art.

It is another object, feature, or advantage of the present invention to apply a musical approach to the sonification of data.

It is a further object, feature, or advantage of the present invention to provide a method and system for creating data-driven music that does not rely upon directly mapping sounds to data.

A still further object, feature, or advantage of the present invention is to provide for sonification of data that is not annoying and is not difficult to understand.

A further object, feature, or advantage of the present invention is to provide for sonification of data that includes phrasing and a sense of forward movement in the sound.

A still further object, feature, or advantage of the present invention is to provide for sonification of data that reveals the rich complexity of the details of the data.

Another object, feature, or advantage of the present invention is to provide a method and system for creating data-driven music that builds in listenability and flexibility for broad applicability to different types of data without external intervention by a composer.

Yet another object, feature, or advantage of the present invention is to provide a method and system for creating data-driven music that incorporates an understanding of how musical phrasing, sentence completion, and listenability are achieved within music.

Yet another object, feature, or advantage of the present invention is to provide for the development of nontonal/atonal music tools to provide a much larger design space with a construction of listenable music.

A further object, feature, or advantage of the present invention is the use of fractal algorithms—specifically Lindenmayer-Systems (L-Systems) to map data into patterns and details that enable the listener to understand the data.

A still further object, feature, or advantage of the present invention is the development of a context sensitive grammar that can capture the interrelationships between parts of the data.

Another object, feature, or advantage of the present invention is to provide a connection between micro- and macro-scales of the data.

Yet another object, feature, or advantage of the present invention is to provide a method for sonification of data that can be used with diverse types of data sets.

One or more of these and/or other objects, features, or advantages of the present invention will become apparent from the specification and claims that follow.

SUMMARY OF THE INVENTION

The present invention includes methods for sonification of data without requiring direct mapping. In particular, the present invention applies a musical approach to the sonification of data. According to one aspect of the present invention, atonal composition techniques are applied to a set of data to provide a sound representation of the data. The atonal composition techniques can apply fractal algorithms, including fractal algorithms derived from Lindenmayer systems.

According to another aspect of the invention variations in data can be represented by motivic contrapuntal transformations and variations in pitch, timbre, rhythm, tempo, and density. The contrapuntal transformations can be transposition, retrograde, or inversion.

According to another aspect of the present invention, different types of data can be associated with different characteristics of the music. For example, micro-scale or lower level events can be represented by contrapuntal transformations while higher level events can be represented with variations in other characteristics of the music.

According to another aspect of the present invention, a method for sonification of a model is disclosed. According to the method, characteristics associated with the model are determined. Next, types of data associated with the characteristics are collected. Then level assignments are determined for each of the types of data. One or more atonal composition techniques are applied to the data to produce sound. The one or more atonal composition techniques are parameterized by the level assignment. The sound produced is then output. The atonal composition techniques can include fractal algorithms. Where there are both higher level and lower levels of data, the lower level types of data can be represented by motivic contrapuntal transformations.

BRIEF DESCRIPTION OF THE FIGURES

FIG. 1 illustrates direct mapping of data to pitches.

FIG. 2 illustrates a sequence of bases or corn DNA.

FIG. 3 illustrates rules for each base.

FIG. 4 illustrates five iterations of the L-system driven by the sequence of corn DNA according to one embodiment of the present invention.

DETAILED DESCRIPTION OF THE PREFERRED EMBODIMENT

Figure 5:
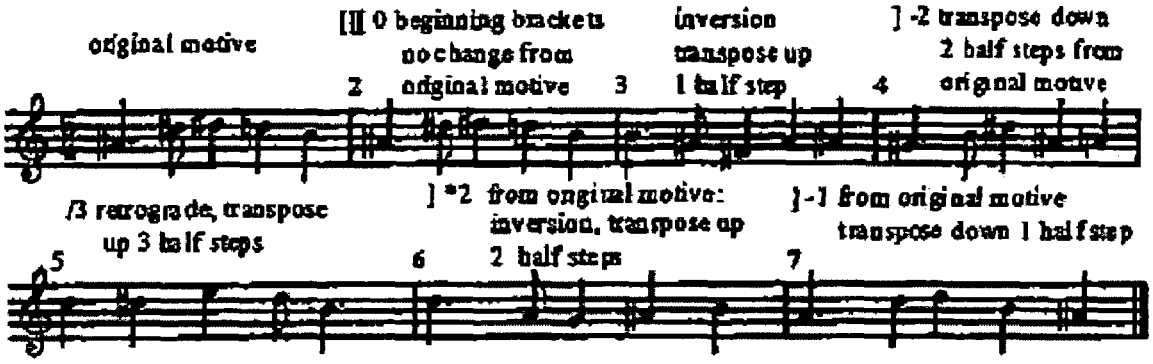
FIG. 5 illustrates music resulting from the methodology of one embodiment of the present invention applied to a data set including corn DNA.

Although tonal music is widely used and understood, its highly developed syntax imposes many constraints on the data. Atonal compositional techniques such as the fractal algorithms of various embodiments of the present invention use a less rigid syntax than tonal music and allow for greater flexibility in developing musical phrasing and movement. Because of this, atonal techniques have the potential to provide a means for sonifying data that can be tailored to the data and applied on-the-fly or in real-time. For greater musicality, this approach uses four principles to guide the choice of grammars.

1) Varying degrees of intensity to give the music a sense of motion. Lower degrees of intensity result from musical factors such as consonant sonorities and predictable rhythmic patters. Conversely, higher degrees of intensity are brought about by dissonant sonorities and unpredictable rhythmic patterns among other factors.
2) Using multiple parameters to create variety to hold the listener's interest and concentration and to increase options for producing varying degrees of intensity.
3) Producing recognizable musical events.
4) Developing a musical grammar to place and alter musical events in time with respect to the flow of the data set.

The present invention is not limited to using these four principles to guide the choice of grammar. The present invention contemplates that numerous other principle, particularly principles associated with a musical approach, can be used.

When nothing remarkable is occurring within the data, the sonification algorithms create music that acts analogously to wallpaper, providing a pleasant, non-demanding background. This music is created in real time in contrast to an unchanging loop commonly heard in game software. When interesting data occurs, the items of interest become more prominent and alert the user.

The fractal algorithms used in this work are derived from Lindenmayer systems (L-systems). L-systems are grammatical representations of complex objects such as plants or other fractals. They are principally used to create models of plants but also have been used as generative models of systems as diverse as traditional Indian art and melodic compositions (Prusinkiewiecz, 1989).

L-systems consist of a collection of rules that specify how to replace individual symbols with strings of symbols. When making plants, a rule can transform a single stick into a structure with many branches. Another round of replacement permits each of the branches to branch again or perhaps to gain leaves. To create an authentic appearance in a virtual plant, L-system grammars allow the development of structures that link micro- and macro-scales. To realize a plant from a string of symbols requires an L-system interpreter. The research presented here utilizes a unique L-system interpreter called the Grammatical Atonal Music Engine (GAME) that uses cues from the data to drive the interpretation. Features of the data influence the choice of rule, thus giving the data control of the music within the bounds set by the grammar.

Bracketed L-systems are used to build complex objects. When the L-system is interpreted, opening brackets save the state of the interpreter on a stack, and closing brackets pop the saved state off of the same stack. In models of plants, brackets manage branching. Musically, the brackets in an L-system could be used in a number of ways such as permitting a musical motive to finish and a new one to begin. This use of bracketed L-systems dictates that the GAME be a state conditioned device. The symbol set contains embedded commands treating various musical state variables, e.g., tempo, pitch, and volume. Data controls the composition of the music in two ways. First low-level or micro-scale details of the data drives the choice of particular motives within the music and various contrapuntal transformation to these motives. Second, higher level (macro-scale) abstractions like DNA melting temperature act to control the higher level parameter symbols within the GAME's L-system grammar. For these larger state variables that indicate interesting data structures, the grammar varies musical elements such as tempo, dynamics, register, instrumental sound, or the number of sounding voices.

To demonstrate one embodiment of the methodology of the present invention, a sample musical example based on a short sequence of corn DNA data is presented. Sonification of DNA data has not, so far, focused on understanding the DNA but rather on the novelty of generating music or sound from the code of life. In contrast to this approach, the GAME generates sound from DNA in a manner that elucidates its statistical character and function. Even simple measures of DNA's statistical character, such as GC-content, which is higher inside genes, contain important information about the function of DNA. Using techniques similar to those of Ashlock and Golden (2000), functionally distinct types of DNA are used as cues to the GAME, creating an audible display of the DNA sequence information.

In this example, the corn DNA sequence in FIG. 2 is used. Each DNA base has its own rule for each alphabet symbol, and each rule includes symbols called interpreters that specify particular actions. In FIG. 4 the first measure gives a beginning motive, and subsequent measures transform this motive according to the instructions given by the L-system interpreters. As the L-system moves through the DNA sequence, it calls up the rule for each base in turn. The interpreters for this example specify which musical transformation is to be performed on the motive, representing either the preceding state of the L-system or a restored state indicated by a bracket. These interpreters denote contrapuntal transformations of the motive, including retrograde, inversion, and transposition. As shown in this example, using this technique creates phrasing within the music based on the data.

The interpreters creating the musical transformations and the use of brackets are explained below. FIG. 3 lists each base and its rule.

These are the interpretations for the symbols:

1) Numeral: transpose down an additional half step for each successive integer below zero, and for each integer greater than zero, transpose up a half step for each successive integer.
2)/: retrograde. A retrograde transformation places the notes of the motive in reverse order.
3)*: inversion. For an inversion transformation each melodic interval in the succeeding motive goes in the opposite direction from the corresponding interval of the previous or restored motive.

The present invention is not, of course, limited to only these particular musical transformations. Rather, the present invention contemplates numerous types of transformations may be used.

FIG. 4 shows five iterations of an L-system driven by this DNA sequence. The fifth iteration results in the musical excerpt in FIG. 5. The first measure gives the original motive, and subsequent measures transform this motive according to the instructions given by the L-system interpreters. Above each measure, the interpretation symbol is given plus an explanation of the transformation it calls for. For example, in measure 2 the symbol is "[[[0". The opening brackets save the motive found in the previous measure, and the "0" calls for no change. For measure 3 the symbol "*1" specifies inverting the motive in the previous measure and transposing it up one half step. For measure 4, the closing bracket ("]") restores the motive before the opening brackets, and the "−2" transposes it down two half steps. This process continues until the end of the piece, which corresponds with the fifth iteration of the L-system.

This algorithm of the present invention enables music sonification for many types of scientific data and other applications. The design has four parts: generalized L-system classes, L-system data file loader specialized for XML, a parameter system, and an L-system renderer specialized for MDI. Unlike earlier sonification software that uses MIDI to directly map musical parameters to data, this software uses MDI to facilitate creating music via L-system algorithms that interface with the data.

The L-system data structure is a parametric one, allowing for grouping of data. For example, a command calling for a note would include the parameters pitch, velocity and what channel to play the note on. The L-system class stores the L-system axiom and production rules. After the class is set up, the user can tell it to apply the rules any number of times to grow the resulting L-string.

The L-system data file format is defined using an XML schema and is constructed with the L-system axiom and a list of production rules. Each production rule has the option of either a regular expression match or an exact match. The "strings" in the format are actually vectors of <elt> nodes. Each elt node is like a character in a string, except that the elt node contains an extra data payload or parameters. This concept is also mirrored in the software. The L-system XML format is not tied to music; because of its general quality, it could be used for many other applications including graphics.

L-system elements are defined as music events. The first ring renderer is an event scheduler that operates on a string of L-system elements (or music events). The renderer turns these events into MIDI events that are sent to the computer audio device. For the scheduler to work, every element needs to contain at least a command followed by a starting time. The scheduler uses the starting time to determine when to execute the event, and it uses the command tag to determine how to execute it. Once it is executed, the other parameters are read. The renderer can be controlled by the application through a parameter system. These parameters can be referenced in the L-system XML format and then resolved on the fly as each event is executed. This allows application data to influence parameters in the music such as pitch, timbre, volume, and tempo.

This technique is useful for selecting production rules based on data defined by the application. This allows a more course-grained approach to sonify macro-scale features in the data via the parameter system. This complements the fine-grained control for sonifying micro-scale features with rhythmic and motivic changes.

The present invention includes a novel technique for the sonification of data called GAME (Grammatical Atonal Music Engine). This technique utilizes fractal algorithms via an L-system interpreter that accesses cues from the data to drive the interpretation. Because it uses atonal music composition techniques via these fractal algorithms rather than tonal constructs, the GAME algorithm has broad applicability to a wide range of data types. Various aspects of the data influence the choice of rules from the algorithm, thus enabling the data to control music production. The additional depth provided by sonification of the data is similar to adding color to scientific data. Where color relies primarily on hue as the means for highlighting change, sound/music can utilize motivic contrapuntal transformations, pitch, timbre, rhythm, tempo, and density (the number of voices involved). Contrapuntal motivic transformations of transposition, retrograde, and inversion are used. The present invention contemplates other variations in the particular musical parameters used. Because of the way these parameters are incorporated within the L-system interpreter, the music can uniquely bring micro-scale phenomena to the macro-scale and allow the user to fully experience the intricacies and interrelationships of the data. Previous sonification efforts have not been able to extract and develop this experience from the data. Although the data is rich, coherent, and often tightly coupled sonification often yields thin and simplistic results. Additionally, by applying several musical principles, the rules embedded in GAME can create music with a sense of phrasing and completion.

The present invention can be used in many types of applications to represent data including such diverse areas as representation of corn DNA, used in computational fluid dynamics, and battlefield management data. For example, three-dimensional laminar flow (e.g., flow through an expansion, around a bend, or flow over a backward step) can be sonified. Characteristics of interest (e.g., reattachment points, areas of high energy loss) can be represented by sound. Similarly, in battlefield management, emerging conditions or other data including data associated with terrain can be represented by sound. The present invention is not limited to these specific applications. Rather, the present invention contemplates use in numerous applications.

Therefore, a method and system for creating data-driven music using context sensitive grammars has been disclosed which is not limited to the specific embodiment described herein. The present invention contemplates numerous variations in the types of applications, the particular musical parameters, and other variations that will be apparent to one skilled in the art having the benefit of this disclosure.

What is claimed is:

1. A method for sonification of data by applying a musical approach within an atonal context, comprising:

receiving the data to sonify;

using cues from the data to drive interpretation of the data into music by (a) distinguishing between micro-scale and macro-scale aspects of the data, (b) for the micro-scale aspects of the data, applying at least one transformational technique to modify a motive associated with the music, (c) for the macro-scale aspects of the data, applying at least one composition technique to vary characteristics of the music, the characteristics selected from the set consisting of tempo, dynamics, register, instrumental sound, and the number of sounding voices;

producing a sound representation of the music; and wherein the interpretation of the data into music uses a fractal algorithm.

2. The method of claim 1 wherein the transformational technique is selected from the set of contrapuntal devices consisting of transposition, retrograde and inversion.

3. The method of claim 1 wherein the fractal algorithm is used in a bracketed Lindenmayer system.

4. A method for sonification of a model, comprising:

determining characteristics associated with the model;

collecting types of data associated with the characteristics;

distinguishing the micro-scale aspects and macro-scale aspects of the data;

applying at least one composition technique to a motive based on the data to produce music, that at least one composition technique parameterized by the type of data, wherein if the aspects of the data are micro-scale, applying at least one transformational technique to modify a motive associated with music, and if the aspects of the data are macro-scale, applying at least one composition technique to vary characteristics of the music;

outputting a sound associated with the music; and wherein the interpretation of the data into music uses fractal algorithms.

5. The method of claim 4 wherein the transformational technique is selected from the set of contrapuntal devices consisting of transposition, retrograde and inversion.

6. The method of claim 4 wherein the fractal algorithms include bracketed Lindenmayer systems.

7. The method of claim 4 wherein the characteristics are selected from the set consisting of tempo, dynamics, register, instrumental sound, and the number of sounding voices.

8. A method for sonification of data in real-time by applying a musical approach, the method comprising:

receiving the data for sonification;

transforming the data into music by applying musical rules based on the data, wherein the musical rules control composition of the music such that micro-scale aspects of the data modifies the motive and macro-scale aspects of the data varies musical elements selected from the set consisting of set consisting of tempo, dynamics, register, instrumental sound, and the number of sounding voices;

outputting a sound associated with the music; and wherein the musical rules are applied using a fractal algorithm.

9. The method of claim 8 wherein the fractal algorithms include a bracketed L-system.

10. The method of claim 8 wherein the motive is modified by applying a contrapuntal transformation.

11. The method of claim 10 wherein the contrapuntal transformation is selected from the set consisting of transposition, retrograde and inversion.

12. The method of claim 8 wherein the musical rules control composition of the music based on parameters determined to correspond to a sense of phrasing or directed musical motion.

13. A method for sonification of data by applying a musical approach, comprising:

receiving the data to sonify, the data comprising a plurality of different types of data;

using cues from the data to drive interpretation of the data into music, wherein the interpretation of the data into music comprises applying transformational techniques to modify a motive associated with the music to thereby capture interrelationships between the different types of data using phrasing and a sense of forward movement;

producing a sound representation of the music; and wherein the interpretation of the data into music uses a fractal algorithm.

* * * * *